US009103069B2

(12) United States Patent
Graveson et al.

(10) Patent No.: US 9,103,069 B2
(45) Date of Patent: Aug. 11, 2015

(54) METHOD FOR DRY SPINNING NEUTRAL AND ANIONICALLY MODIFIED CELLULOSE AND FIBRES MADE USING THE METHOD

(75) Inventors: Ian Graveson, Nuneaton (GB); Philip Turner, Edinburgh (GB)

(73) Assignee: SAPPI Netherlands Services B.V., Maastricht (NL)

( * ) Notice: Subject to any disclaimer, the term of this patent is extended or adjusted under 35 U.S.C. 154(b) by 0 days.

(21) Appl. No.: 14/003,850

(22) PCT Filed: Mar. 8, 2012

(86) PCT No.: PCT/EP2012/053987

§ 371 (c)(1), (2), (4) Date: Oct. 21, 2013

(87) PCT Pub. No.: WO2012/120073

PCT Pub. Date: Sep. 13, 2012

(65) Prior Publication Data

US 2014/0041821 A1 Feb. 13, 2014

(30) Foreign Application Priority Data

Mar. 8, 2011 (EP) ..... 11157311

(51) Int. Cl.

| | |
|---|---|
| ***D21C 9/00*** | (2006.01) |
| ***D01D 1/02*** | (2006.01) |
| ***D01D 5/40*** | (2006.01) |
| ***D01F 2/00*** | (2006.01) |
| ***D01F 2/24*** | (2006.01) |
| ***D21H 13/02*** | (2006.01) |
| *D21H 15/00* | (2006.01) |

(52) U.S. Cl.

CPC .. *D21C 9/00* (2013.01); *D01D 1/02* (2013.01); *D01D 5/40* (2013.01); *D01F 2/00* (2013.01); *D01F 2/24* (2013.01); *D21H 13/02* (2013.01); *D21H 15/00* (2013.01)

(58) Field of Classification Search

USPC ..... 264/176.1, 204, 207, 208; 162/157.1, 162/157.6; 536/56, 58, 59, 62, 63; 977/700, 977/788, 795

See application file for complete search history.

(56) References Cited

U.S. PATENT DOCUMENTS

| | | | | |
|---|---|---|---|---|
| 3,357,845 | A | 12/1967 | Battista et al. | |
| 5,603,883 | A | 2/1997 | Zikeli | |
| 5,725,821 | A * | 3/1998 | Gannon et al. ..... | 264/203 |

FOREIGN PATENT DOCUMENTS

WO 2010/043889 A1 4/2010

OTHER PUBLICATIONS

Xue Min Dong et al., "Effect of microcrystallite preparation conditions on the formation of colloid crystals of cellulose" Cellulose, Jan. 1998, pp. 19-32, vol. 5, No. 1.

International Search Report for PCT/EP2012/053987 dated May 23, 2012.

* cited by examiner

*Primary Examiner* — Dennis Cordray

(74) *Attorney, Agent, or Firm* — Sughrue Mion, PLLC

(57) ABSTRACT

The present invention is directed towards a method for spinning neutral or anionically modified cellulose comprising the steps of: (a) preparing a suspension of the neutral or anionically modified cellulose in a continuous phase; (b) subjecting the suspension to high shear rate; (c) performing spinning by extruding the cellulose suspension into an airgap region comprising at least one heated zone to obtain spun fibers, (d) subjecting the spun fibers to at least one washing stages and (e) isolating the spun fibers from the at least one washing stages; as well as fibers obtained based on the method of the invention and paper or board products derived from such fibers.

16 Claims, No Drawings

METHOD FOR DRY SPINNING NEUTRAL AND ANIONICALLY MODIFIED CELLULOSE AND FIBRES MADE USING THE METHOD

CROSS REFERENCE TO RELATED APPLICATIONS

This application is a National Stage of International Application No. PCT/EP2012/053987 filed Mar. 8, 2012, claiming priority based on European Patent Application No. 11 157 311.9, filed Mar. 8, 2011, the contents of all of which are incorporated herein by reference in their entirety.

FIELD OF THE INVENTION

The present invention is directed towards a method for spinning neutral or anionically modified cellulose, fibres obtained based on the method of the invention and paper or board products derived from such fibres.

BACKGROUND OF THE INVENTION

Cellulose in particular in the form of fibres can be used for many applications and products, so e.g. for the making of paper or board structures, but also for making spun fibres such as viscose fibres or lyocell fibres which show excellent mechanical properties. Due to the chemical nature of cellulose in principle acceptable properties as concerns e.g. tensile strength can be reached, however the starting material for the spinning process, the so called spinning suspension, as well as the extrusion and subsequent solidification e.g. in a spin bath can often release hazardous and noxious materials, for example carbon disulphide and hydrogen sulphide which need to be recovered. In addition these commercial systems are currently unable to achieve very high tensiles, for example greater than 85 cN/tex.

SUMMARY OF THE INVENTION

The present invention is directed towards an improved method for spinning neutral or anionically modified cellulose, fibres obtained based on these methods and paper or board products derived from such fibres.

More specifically, the invention provides a method for spinning neutral or anionically modified cellulose comprising the steps of: (a) preparing a neutral or anionic cellulose suspension of the neutral or anionically modified cellulose in a continuous phase; (b) subjecting the neutral or anionic cellulose suspension to high shear rate; (c) performing spinning by extruding the neutral or anionic cellulose suspension into an airgap region comprising at least one heated zone to obtain spun fibres, (d) subjecting the spun fibres to at least one washing stage and (e) isolating the spun fibres from the at least one washing stage.

As used herein, the term "nanofibril" or "nanofibrillar" in combination with cellulose refer to cellulose that is substantially completely in the form of nanofibrils, and those which may be substantially nanofibrillated while containing minor but not significant amounts of non-nanofibrillar structure, provided that the cellulose is in sufficient nanobrillar form to confer the benefits necessary for use in the methods of the present invention. Nanofibrils obtained from anionically modified cellulose are referred to as anionic cellulose nanofibrils or nanofibrillar anionically modified cellulose. Nanofibrils obtained from neutral cellulose are referred to as neutral cellulose nanofibrils or nanofibrillar neutral cellulose.

The cellulose nanofibrils may be extracted from nanofibril containing cellulose-based material, including hydrolyzed or mechanically disintegrated cellulose obtained from cotton linter, hard or soft wood pulp, purified wood pulp or the like, commercially available cellulose excipients, powdered cellulose, regenerated cellulose, microcrystalline and low crystallinity celluloses. Preferred cellulose sources are derived primarily from wood pulp. Suitable wood pulp fibres include ground wood fibres, recycled or secondary wood pulp fibres, and bleached and unbleached wood pulp fibres. Both softwoods and hardwoods can be used. Details of the selection of wood pulp fibres are well known to those skilled in the art.

In case of anionically charged nanofibrils, suitable wood pulp fibres can be obtained from well known chemical processes such as the kraft and sulfite processes, with or without subsequent bleaching. Pulp fibres can also be processed by thermomechanical, chemi-thermomechanical methods, or combinations thereof. Preferably the cellulose is obtained by chemical pulping and extraction. The anionic charge is preferably provided by derivatisation with suitable groups carrying a negative charge, such as sulphur-containing groups (e.g. sulfate, sulfonate, alkylsulfate, alkylsulfonate), carboxyl and carboxymethyl groups, phosphor-containing groups (e.g. phosphate, phosphonate), nitro groups or the like, or combinations thereof.

These are characterized by an average length in the range of 15-300 nm, preferably in the range of 50-200 nm. The average thickness is preferably in the range of 3-3000 nm, preferably in the range of 10-100 nm.

In specific embodiments the anionically modified cellulose nanofibril is a cellulose nanofibril derivatized with sulphur containing groups, such as sulfated or sulfonated cellulose nanofibrils.

In a further preferred specific embodiment, the anionically modified cellulose is sulfur-derivatized cellulose, more specifically sulfur-derivatized cellulose nanofibril. Thus, as used herein "sulfur-derivatized cellulose nanofibril" refers to a cellulose nanofibril that has been derivatized with anionically charged sulfur groups by reaction of a cellulose nanofibril with a suitable sulphating agent. It will be appreciated that sulfur-derivatized cellulose nanofibril includes free acid and salt forms where appropriate. A sulfur-derivatized cellulose nanofibril can be produced by reacting a sulfating agent with a hydroxyl group of the cellulose nanofibril to provide a cellulose sulphate ester according to literature procedures (see e.g. Cellulose (1998) 5, 19-32 by Dong, Revol and Gray).

The degree of substitution of anionically modified groups on the cellulose nanofibril should be sufficiently low such that the derivatized cellulose nanofibril will be substantially insoluble in the solvent that is present in the intended methods of the invention.

In specific embodiments, the anionically modified cellulose nanofibre of the invention can be characterized as having an average degree of substitution by an anionic group of from about 0.01 to about 2. In one embodiment the modified cellulose nanofibre has an average degree of substitution by an anionic group of less than 1.0, preferably less than 0.5.

As used herein the "average degree of substitution by an anionic group" refers to the average number of moles of the respective anionic group per mole of glucose unit in the modified nanofibril. Thus, the average degree of e.g. sulfate group substitution refers to the average number of moles of sulfate groups per mole of glucose unit in the modified nanofibril.

Preferably the suspension of the anionically modified cellulose (i.e. the anionic cellulose suspension) is prepared in a continuous phase, in which the anionically modified cellulose is substantially insoluble. The term "substantially insoluble" refers to such a small degree of solubility so as not to effect the nanofibrillar structure of the cellulose. It is understood that the solubility of the anionically modified cellulose depends on the degree of substitution with the anionically charged groups. The term "continuous phase" refers to a liquid in which the anionically charged or neutral cellulose is dispersed, with or without the presence of additives. Examples of a suitable continuous phase includes aqueous solvents, alcohols, ethers, ketones, preferably aqueous solvents, more preferably water. The term "aqueous solvent" refers to a solvent comprising at least 50%, preferably at least 80%, more preferably at least 90% and optimally from 95 to 100% water by weight of the solvent. The aqueous solvent may have a pH of from 2 to 10, more preferably from 4 to 8 and optimally from 5.5 to 7.5 at 20° C.

Preferably, for the spinning step, the suspension of the anionically modified cellulose is provided in a concentration range of between about 0.01% and about 100%, preferably between about 1.0% and 80%, more preferably between about 5.0% up to about 60%.

If desired, cationic additives may be added to the suspension of anionically modified cellulose nanofibrils to provide latent crosslinking capability during the drying stage.

In specific embodiments, the cationic additive refers to a molecular substance that carries at least two positive charges when it is in solution in a protic solvent, preferably in aqueous solution, and in a given pH-range. Preferably, the cationic additive includes monovalent or polyvalent organic cationic species, including metal cations. The term "polyvalent cation" refers to a cation having a charge of at least equal to 2 and includes preferably divalent metal cations such as zinc, magnesium, manganese, aluminium, calcium, copper and the like.

Preferably, the cationic additive is an inorganic cationic species having a charge of preferably 2 to 4, such as zinc, aluminium, calcium and magnesium, more preferably zinc and aluminium.

Preferably, the cationic complexing agent comprises a metal cation or inorganic cationic species at a concentration from 0.1 ppm to 10,000 ppm, more preferably from 10 to 5000 ppm.

In case of neutral cellulose, the neutral cellulose is preferably a (neutral) cellulose nanofibril isolated by use of chemical or mechanical degradation or a combination of both process stages on the starting cellulose-based material as defined hereinabove. In specific embodiments, the neutral cellulose nanofibrils may be obtained by mixing finely shredded cellulose-based starting material as defined hereinabove with a non derivatising mineral acid, for example hydrochloric acid, boiling said mixture for between 10 minutes and 5 hours. Preferably the concentration of the derivatising mineral acid is between 0.1 to 90%, preferably 10 to 60%.

The obtained mixture is filtered and the extracted cellulosic material with or without prior drying is subject to mechanical shear for example using a ball mill or attritor device to obtain the neutral cellulose nanofibrils.

The neutral cellulose nanofibril is characterized by an average length in the range of 15-300 nm, preferably in the range of 50-200 nm. The average thickness is preferably in the range of 3-3000 nm, preferably in the range of 10-100 nm.

To obtain the neutral cellulose suspension, the neutral cellulose may then be suspended in a fluid medium comprising a suspending agent and a continuous phase (as defined hereinabove). A suitable suspending agent may be a natural gum (e.g. gum arabic, gum tragacanth, guar gum, locust bean gum, carrageenan) a pectin, an alginate, a cellulose derivative (e.g. hydroxypropylmethylcellulose, methyl cellulose, hydroxypropylcellulose, carboxymethylcellulose), preferably methyl cellulose (such as the methyl cellulose supplied by Dow Wolff Cellulosics under the trade name Methocel). A suitable continuous phase may be selected from aqueous solvents, e.g. water, or organic solvents, e.g. methylene chloride, methanol, propanol and dimethyl sulphoxide and the like.

Optional additional process steps include e.g. purification and concentration of the fibres obtained from either the neutral or anionically modified cellulose according to the methods of the invention. Thus in one embodiment, the methods of the invention further comprise a purification step such as diafiltration (for example using the equipment provided by Memcon of South Africa using ceramic membranes supplied by Atech Innovations of Germany) which refers to any technique in which the solvent and small solute molecules present in a suspension of the fibres are removed by ultrafiltration and replaced with different solvent and solute molecules. Diafiltration may be used to alter the pH, ionic strength, salt composition, buffer composition, or other properties of a suspension of the fibres. Unless otherwise specified, the term diafiltration encompasses both continuous and batch techniques. In another embodiment, the methods of the invention further comprise a concentration step wherein the percentage solids in the solvent are increased. The concentration steps may be performed using, for example, a twin screw extruder fitted with one or more vacuum extraction stages, a LIST compounder fitted with vacuum extraction, a BUSS filmtruder etc.

The term "high shear", as used herein, means a shear rate of more than about 1000 $sec^{-1}$, preferably more than 10,000 $sec^{-1}$ and more preferably more than 20,000 $sec^{-1}$. In one embodiment, this stage is positioned immediately before the spinning stage. In a further embodiment, it is placed close to the spinneret and after all concentration and purification stages. The necessary high shear conditions are obtained using e.g. a series of one or more sintered metal plates with pores sizes of 1 to 50 μm, preferably 5 to 25 μm. If preferred a mixture of pore size plates can be used in stacked arrangement. Alternatively a mechanical throttle device can be used such as a zero die having an orifice of 10 to 1000 μm diameter, more preferably 20 to 200 μm.

Immediately prior to extrusion, the neutral or anionic cellulose suspension is heated to aid removal of water in the drying zones. The gel temperature as it enters the spinneret is preferably 25 to 99° C., more preferably 70 to 95° C.

The spinning is performed by extruding the neutral or anionic cellulose suspension through a spinneret into a heated drying zone. The spinneret preferably has hole sizes in the range 40 to 250 μm, preferably 60 to 120 μm. Typically, spinnerets may have between 1 and 50,000 holes. The neutral or anionic cellulose suspension is extruded into an airgap region comprising one or more of these heated drying zones with the temperature in these zones being preferably in the range 75 to 600° C., more preferably in the range 100 to 500° C. In specific embodiments, a draw down ratio as large as 1 to 300%, but preferably 1 to 9% is employed (to prevent lateral movement of the filaments in the drying zone).

In other embodiments, an air knife blowing and/or an air extraction stage may be applied inside one or more of the above defined heated drying zones to assist with water removal. The air being blown onto the drying fibres is preferably heated and fully dehumidified air, preferably at temperatures above 100° C., preferably between 100 and 600° C., and with a water content of less than 50 g/l of air, more preferably less than 5 g/l, most preferably between 0.01 and 5 g/l. In further embodiments, the fibres derived from either the neutral or anionically modified cellulose are subjected to one or more washing steps after drying to remove residual salts and/or the continuous phase, etc. used to create the suspension.

Typically the one or more washing steps include using a nip roller at the exit of the drying zones which carry the fibre through a series of hot water washing stages until non cellulosic residues as removed to acceptable levels.

In yet further embodiments, an optional acid washing stage or an optional alkali washing stage or an optional steaming stage may be incorporated to assist with removal of residues.

Preferably, the temperature of the washing stages is between 15 and 98° C., more preferably 70 and 90° C. Typically, sufficient tension is maintained in the washing stages to prevent substantial excessive sagging of the filaments in the spinbath.

In yet a further embodiment, the obtained fibre is dried in the usual manner as known in the art, e.g. using a hot drum dryer, conveyer belt dryer, infrared heaters and the like. Typically, tension may be applied during this process.

The term "tension" as used herein applies to both the tension applied during one or more washing and one or more drying stages of the methods of this invention, and is typically maintained at 0.05 to 0.35, preferably at 0.05 to 0.25 grams per denier.

In further embodiments, the dried fibre may be collected onto creels or bobbins and washed off line in the normal manner utilised in the cellulosic fibre textile industry.

DETAILED DESCRIPTION OF THE INVENTION

The invention shall now be illustrated and supported by specific examples. However these examples shall no be used or construed to limit the scope of the invention as detailed above and as defined in the appended claims.

Example 1

A suspension of cellulose nanofibrils, derivatized to carry a negative charge, was heated to 90° C. and extruded through a stack of porous sintered metal plates comprising a 25 μm plate, then a 5 μm plate followed by a third of 25 μm closest to the spinneret. The suspension of the anionically modified cellulose nanofibrils was then extruded through a spinneret with an 80 μm exit diameter into the first airgap zone measuring 80 cm in length which was heated to 400° C. A draw ratio of 5% was applied to prevent movement of the nanofibrils. At the end of this zone a perforated circular tube was placed to fit around the filaments and blowing air at 200° C. and 2 g/l water at 2 msec and a downwards angle of 45 degrees from the perpendicular towards the filaments as they passed top to bottom through this device. The second drying zone was heated to 250° C. and is 100 cm in length after which the dried fibre were collected through a nip roller and transported into a washing bath system comprising three baths separated by clover leave rollers. The washing water was held at 95° C. Following washing the fibres were then re-dried as known from the prior art (such as using a hot drum dryer, conveyer belt dryer, infrared heaters and the like). The resultant fibre had a tenacity of at least 100 cN/tex

Example 2

Cellulose nanofibrils extracted using hydrochloric acid followed by mechanical grinding were suspended with mixing in a 2% solution of a Dow Wolff Methocel grade having a number average molecular weight of 220,000 and a solution viscosity of 75,000 mP×s (measured as a 2% solution at 20° C. using an Ubbelohde viscometer). The cellulose solids content was 25% w/w. The neutral nanofibril suspension at 30° C. was extruded through a zero die with an orifice diameter of 100 μm and then directly into a spinneret with an 80 μm exit diameter into a 50 cm long heated drying zone at 200° C. A second drying zone was directly below the first, which was heated to 250° C. and was 100 cm in length after which the dried fibres were collected through a nip roller and transported into a washing bath system comprising three baths separated by clover leave rollers. The washing water was held at 95° C. Following washing the fibres were then re-dried in the normal manner (as indicated hereinabove).

Example 3

A suspension of anionic cellulose nanofibrils was created following the method set out in Cellulose (1998) 5, 19-32. This was purified and partially concentrated using a diafiltration unit from Memcon and ceramic membrane from Atech Innovation. The suspension was then concentrated to a solids content of 30% w/w cellulose in an aqueous solvent. During the concentration processes 100 ppm of zinc sulphate (on cellulose) was added with mixing. The resulting concentrated suspension of cellulose nanofibrils heated to 90° C. was extruded via a high shear device connected directly to a spinneret with a 100 μm exit diameter. The remainder of the spinning process was performed as defined in example 1 (see above).

The invention claimed is:

1. A method for spinning neutral cellulose comprising the steps of:

(a) preparing a neutral cellulose suspension of the neutral cellulose in a continuous phase;

(b) subjecting the neutral cellulose suspension to high shear rate;

(c) performing spinning by extruding the neutral cellulose suspension into an airgap region comprising at least one heated zone to obtain spun fibres, (d) subjecting the spun fibres to at least one washing stages, and (e) isolating the spun fibres from the at least one washing stages, wherein the neutral cellulose is substantially in form of neutral cellulose nanofibrils obtained by (i) mixing finely shredded nanofibril containing cellulose-based material, with a non derivatizing mineral acid to obtain a mixture, (ii) filtering said mixture to obtain an intermediate cellulosic material, and (iii) subjecting said cellulosic to mechanical shear to obtain the neutral cellulose nanofibrils.

2. The method according to claim 1, wherein the at least one heated zone has a temperature in the range 75-600° C.

3. The method according to claim 1, wherein the spun fibres obtained in step (c) are subjected to an air knife blowing and/or an air extraction stage.

4. A fibre obtained through a method according to claim 1.

5. A paper or board composition comprising a fibre according to claim 4.

6. A method for spinning neutral cellulose comprising the steps of:

(a) preparing a neutral cellulose suspension of the neutral cellulose in a continuous phase;

(b) subjecting the neutral cellulose suspension to high shear rate;

(c) performing spinning by extruding the neutral cellulose suspension into an airgap region comprising at least one heated zone to obtain spun fibres, (d) subjecting the spun fibres to at least one washing stages and (e) isolating the spun fibres from the at least one washing stages, wherein the neutral cellulose suspension is obtained by suspending the neutral cellulose in a fluid medium comprising a suspending agent and a continuous phase.

7. A method for spinning neutral or anionically modified cellulose comprising the steps of:

(a) preparing a neutral or anionic cellulose suspension of the neutral or anionically modified cellulose in a continuous phase;

(b) subjecting the neutral or anionic cellulose suspension to high shear rate;

(c) performing spinning by extruding the neutral or anionic cellulose suspension into an airgap region comprising at least one heated zone to obtain spun fibres, (d) subjecting the spun fibres to at least one washing stages and (e) isolating the spun fibres from the at least one washing stages, wherein a draw down ratio of 1-9% is applied.

8. The method according to claim 7, wherein the anionic cellulose nanofibrils are obtained from nanofibril containing cellulose-based material using chemical, thermomechanical, chemi-thermomechanical processes, or combinations thereof.

9. The method according to claim 7, wherein the anionically modified cellulose is substituted with groups carrying a negative charge, chosen from sulphur-containing groups, carboxyl groups, phosphor-containing groups, nitro groups, or combinations thereof.

10. The method according to claim 9, wherein the anionically modified cellulose has a degree of substitution of less than 0.5.

11. The method according to claim 7, wherein the anionic cellulose suspension is obtained by dispersing or suspending the anionically modified cellulose in a continuous phase in which the anionically modified cellulose is substantially insoluble.

12. The method according to claim 7, wherein the spun fibres obtained in step (c) are subjected to an air knife blowing and/or an air extraction stage.

13. A fibre obtained through a method according to claim 7.

14. A paper or board composition comprising a fibre according to claim 13.

15. The method according to claim 7, wherein the anionic cellulose nanofibrils are obtained from nanofibril containing cellulose-based material by chemical pulping and extraction.

16. The method according to claim 7, wherein the at least one heated zone has a temperature in the range 75-600° C.

* * * * *